US005295536A

United States Patent [19]

Bode

[11] Patent Number: 5,295,536

[45] Date of Patent: Mar. 22, 1994

[54] DRILLING MUD CONTAINER APPARATUS

[76] Inventor: Robert E. Bode, 14306 Reissen La., Houston, Tex. 77069

[21] Appl. No.: 980,248

[22] Filed: Nov. 23, 1992

[51] Int. Cl.[5] ..... E21B 33/08

[52] U.S. Cl. ..... 166/81; 166/93; 166/241.7; 175/84; 175/208

[58] Field of Search ..... 166/77.5, 81, 93, 241.6, 166/241.7, 243; 175/66, 84, 202, 207–209

[56] References Cited

U.S. PATENT DOCUMENTS

| | | | |
|---|---|---|---|
| 234,825 | 11/1880 | Walker | 166/81 |
| 1,417,811 | 9/1922 | Heeter | 166/81 |
| 1,632,889 | 6/1927 | Davis | 166/81 |
| 1,868,794 | 7/1932 | Fuller et al. | 166/81 |
| 2,096,882 | 10/1937 | Chernosky | 166/81 |
| 2,522,444 | 9/1950 | Grable | 166/93 X |
| 4,450,905 | 5/1984 | Crain | 175/209 X |

*Primary Examiner*—Ramon S. Britts
*Assistant Examiner*—Roger J. Schoeppel
*Attorney, Agent, or Firm*—Bush, Moseley & Riddle

[57] ABSTRACT

In accordance with an illustrative embodiment of the present invention, a container for preventing spilling of drilling mud onto the rig floor to thereby save the mud for later reuse includes a diametrically split and hinged barrel having a fixed lower seal assembly and a movable upper seal assembly which engage the outer wall of the drill pipe respectively below and above a joint connection that is to be unthreaded. Upon disconnection and upward movement, the upper seal moves upward with the pipe to totally eliminate wear which otherwise would result in seal and mud leakage.

9 Claims, 2 Drawing Sheets

DRILLING MUD CONTAINER APPARATUS

FIELD OF THE INVENTION

The invention relates generally to a device for preventing drilling mud from being spilled onto the rig floor when a threaded connection between joints of drill pipe is disconnected, and particularly to a container assembly which is receivably positioned around the drill pipe adjacent such connection and sealed with respect to the drill pipe so as to catch the spilled mud and route it to a mud pit where it is saved for further use in the mud circulation system of the drilling rig.

BACKGROUND OF THE INVENTION

The drilling of an oil well usually employs so-called "mud" which is a weighted liquid that is pumped down through the drill string and out the nozzles of the drill bit, where it circulates up through the annulus between the drill string and the wall of the borehole and returns to the surface. Here the mud is processed to remove cuttings and then fed to a pit where it is available for additional circulation down the drill string. The mud performs several vital functions in connection with the drilling of a well, for example it cools the bit, carries rock cutting from the bit to the surface, and prevents a blow out by overbalancing the pressure of fluids in the earth formations penetrated by the borehole. The various density-increasing additives which are used to form the drilling mud also tend to filter into the formation and thereby form a mud-cake on the hole walls which stabilize it. The increased thickness or mud-cake that is formed provides an indication of those formations which are more permeable than others.

When the drill pipe string is being removed from the well, for example to substitute a new for a worn bit, the drilling mud that remains in the string can cause serious problems. Typically the derrick of the rig is tall enough that the drilling string can be removed and stacked in "triples", that is to say only every third connection is unthreaded so that a series of three pipe joints still connected together (stand) are stacked in the derrick for later re-running. However approximately a 90 ft. column of drilling mud remains inside each stand as it arrives at the surface, so that when a threaded joint is disconnected, the mud suddenly spills onto the rig floor where a portion of it goes through and onto the ground or water surface therebelow, while other portions splash onto rig personnel and onto various parts of the rig around the floor. Not only is a very messy and hazardous situation created each time a joint is disconnected, which requires a thorough clean up, the total volume of spilled and wasted mud can have serious impact in the economics of drilling, not to mention ground or water pollution which can have a serious ecological impact.

In an attempt to prevent spillage, one device that has been used is shown in the 1978–79 "Composite Catalog of Oilfield Equipment and Services", Vol. 3, page 5303. This device comprises a barrel assembly having hinged halves which carry diametrical split seals at its upper and lower ends that engage outer peripheral surfaces of the drill pipe. After a threaded pipe connection has been spun loose, but not yet actually separated, the assembly is positioned and latched closed around the pipe. Then when the stand of pipe is raised upward, the mud therein is dumped into the barrel where it is carried away by a swivel mounted drain line. However repeated upward movements of the drill pipe through the split seal at the upper end of the barrel soon causes considerable wear on the upper seal due to the rough and abrasive nature of the outer pipe surface. Soon the upper seal begins to leak mud out on the rig floor so that expensive drilling muds are lost and the rig floor must be washed down or else accidents will occur due to slippery conditions.

Another device that has been offered is a so-called "mud bucket" which is designed for use with a drilling rig having an automatic pipe handling system, and is opened and closed by hydraulic cylinders which are mounted on a massive scissor-like structure that enables remote control. This device is extremely expensive to make and to maintain, and is subject to failure in the event the hydraulic lines leak or are disrupted by pipe handling operations in the derrick or on the rig floor.

An object of the present invention is to provide a new and improved means to contain and save the drilling mud which comes out of the lower end of a length of a drill pipe when a threaded joint at its lower end is disconnected.

Another object of the present invention is to provide a new and improved tubular container assembly that is removably positioned around a drill string adjacent a threaded connection therein to catch and save the mud coming out of the lower end of the upper threaded joint as the connection is replaced.

SUMMARY OF THE INVENTION

These and other objects are attained in accordance with the concepts of the present invention through the provision of an elongated, generally tubular container that is formed in part by two semi-circular members which are hinged together on their rear edges to enable them to be opened, positioned around the pipe, and then closed and latched to form a circumferentially continuous container. A diametrically split seal mounting ring attached to the lower end of the container carries an internal seal assembly which engages the outer periphery on the pipe below the threaded connection that is to be disconnected. A guide sleeve, also diametrically split, is mounted inside the upper end portion of the container, and has at least one longitudinal slot which extends radially through the wall thereof. A split seal sleeve is mounted for longitudinal sliding movement within the guide sleeve, and a follower on the seal sleeve extends outward into the slot to stop relative sliding movement at lower and upper positions. A packing assembly which is mounted in internal annular grooves in each half of the seal sleeve engages adjacent outer surfaces of the pipe to provide a static seal. Longitudinal seals also are provided between the rear and front edges of the container members which provide pack-offs when the members are closed and latched. When the thread pipe joint is disconnected and the pipe stands raised upward, the seal sleeve moves upward with the pipe until the follower engages the upper end of the slot in the guide sleeve. During such movement, the mud column in the stand is dumped into the tubular container assembly and is allowed to drain to the mud pit via a suitable hose which is connected to an outlet fitting at the bottom of the container. The fact that the upper seal assembly moves upward with the drill pipe after disconnection of the joint, and without any relative sliding, ensures that no serious wear occurs which could otherwise let the mud spill to the outside. Of course the lower seal assembly also remains essentially stationary relative to the pipe and thus does not wear in repeated usage. Therefore the mud which is dumped out of the bottom of the pipe stand is fully contained without any leakage, which obviates the various problems noted above.

BRIEF DESCRIPTION OF THE DRAWINGS

The present invention has these and other objects, features and advantages as will become more clearly apparent in connection with the following detailed description of a preferred embodiment, taken in conjunction with the appended drawings in which.

DETAILED DESCRIPTION OF A PREFERRED EMBODIMENT

Figure 1:
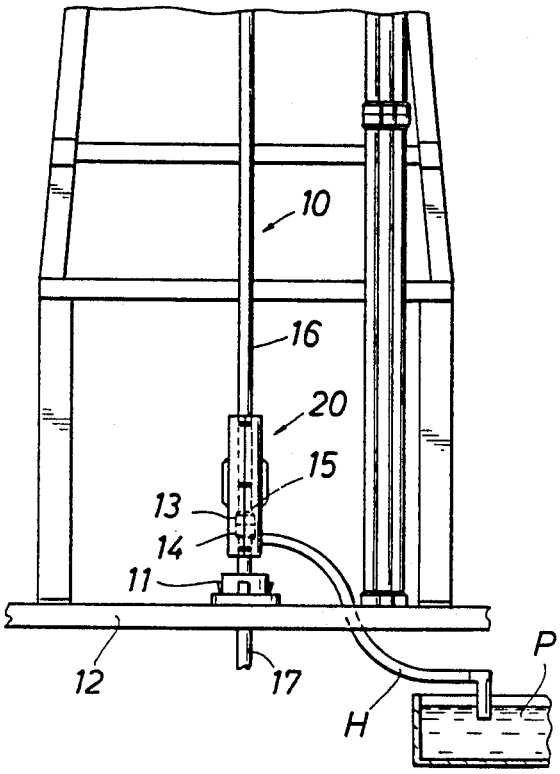
FIG. 1 is a somewhat schematic view showing a drill pipe string being removed from the well while the present invention is in use.

Referring initially to FIG. 1, a drill pipe string indicated generally at 10 is being pulled from the well through the rotary table 11 which is mounted on the rig floor 12. The pipe string 10 consists of a large number of individual joints or sections which are about 30 ft. long and which are threaded end-to-end by connections 15. Each connection 15 includes a male pin 13 and a female box 14 which can be formed on an enlarged diameter or external "upset" end sections of the respective joints 16, 17. The typical drilling rig in use today has a derrick or mast which is high enough so that only every third one of the connections 15 need be unthreaded, leaving three pipe joints, called a "triple stand" still connected end-to-end. Such stands are lifted, set aside, and stacked upright to one side of the derrick until the drill string 10 is to be run back into the well. Smaller rigs may run or pull "doubles" or two pipe sections threaded end-to-end.

It will be recognized that when a connection 15 is unthreaded at the lower end of a triple stand, there can be approximately a 90 ft. column of heavy drilling mud inside the stand which will be suddenly dumped or spilled out of the bottom end of the pipe 16 and onto the rig floor 12 unless something is done to contain the mud. A new and improved mud container apparatus 20 which is constructed in accordance with the present invention is employed for this purpose.

Figure 2:
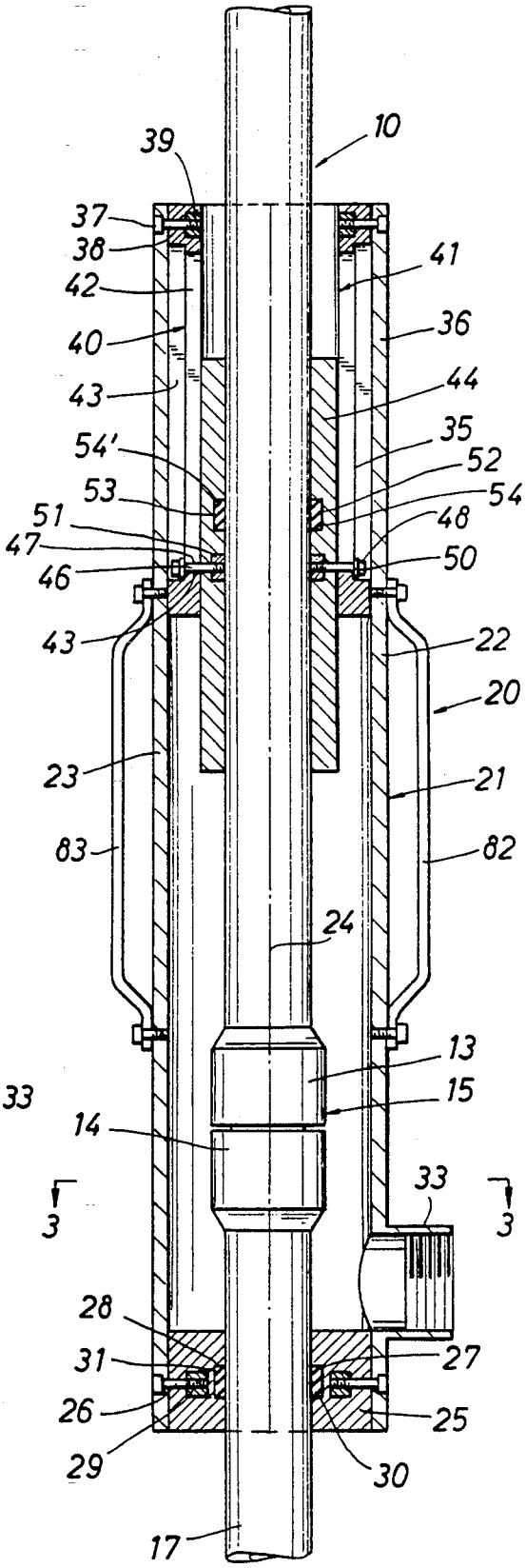
FIG. 2 is a longitudinal cross-section view of the mud containing assembly of the present invention, with some portions shown in elevation.

As shown in FIG. 2, the container apparatus 20 is shown schematically as including an elongated tubular barrel 21 which, as will be explained further below, is formed in two semicircular halves or members 22, 23 which are hinged together along their vertical back side portions which are located along the dash-dot-dash line 24. The bottom end portion of the barrel 21 is closed by a diametrically split ring member 25 whose two halves are fixed to the members 22, 23 by suitable means such as threaded studs 26 which extend into fixed nuts 29. Semicircular grooves 27, 28 in the respective halves of the ring member 25 receive packing elements 30, 31 which sealingly engage the adjacent outer wall surfaces of the pipe joint 17 below the threaded connection 15. A large drain port 33 is formed just above the ring member 25, and is adapted to be connected to a suitable flexible hose (not shown) which leads to a mud pit or tank.

A guide sleeve 35 is mounted in the upper portion 36 of the tubular barrel 21 and is fixed thereto by several studs 37, each of which extends radially through a hole 38 and into engagement with a threaded nut 39. Like all other members discussed above, the sleeve 35 is cut diametrically into two semicircular halves which can be opened and closed with the barrel 21. Longitudinally extending slots 40, 41 are formed through the walls of the respective halves of the guide sleeve 35, each slot having a narrow inner portion 42 and a wider outer portion 43. A seal sleeve member 44 which also has two separate halves is slidably mounted inside the guide sleeve 35, and is coupled thereto by several stop members 43 which can take the form of threaded studs 46 whose shanks 47 are received by the inner portion 42 of the radial slots 40, 41, and whose heads 48 and washers 50 are received in the wider portions 43 of the slots. The inner end portion of each stud 46 is threaded to a nut 51 which is embedded in the wall of said sleeve 44. Internal annular grooves 52, 53 in the respective halves of the seal sleeve 44 carry packing rings 54, 54' which are sized to engage the adjacent outer surfaces of the drill pipe 10 when the container assembly 20 is closed therearound.

Figure 4:
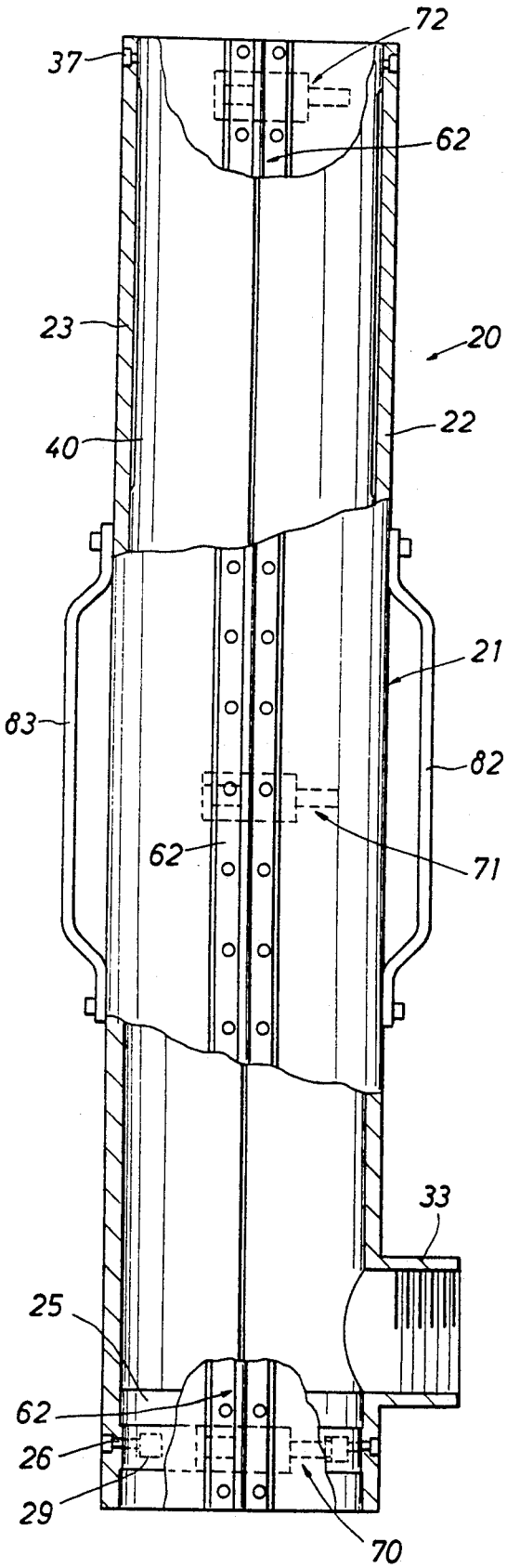
FIG. 4 is a longitudinal cross-section view from the rear, with some portions in elevation.

As shown in further detail in FIG. 4, the adjacent rear portions 60, 61 of the tubular housing members 22, 23 are formed with planar outer surfaces to which the sides of an elongated "piano" hinge assembly 62 are fixed by suitable means. One or both of the confronting faces of the portions 60, 61 are lined with an elastomer strip 63 which is squeezed into sealing engagement when the members 22, 23 are closed as shown. The adjacent front portions 64, 65 of the members 22, 23 also have longitudinal confronting faces, and one portion 65 has a rib or tongue 66 that fits into a companion groove 67 on the other portion 64 to ensure precise alignment when the members 22, 23 are closed. Elastomer strips 68, 69 are adhered to one member to the front and rear of the rib 66 and the groove 67, and these strips also are squeezed into sealing contact when the members 22, 23 are closed.

Figure 3:
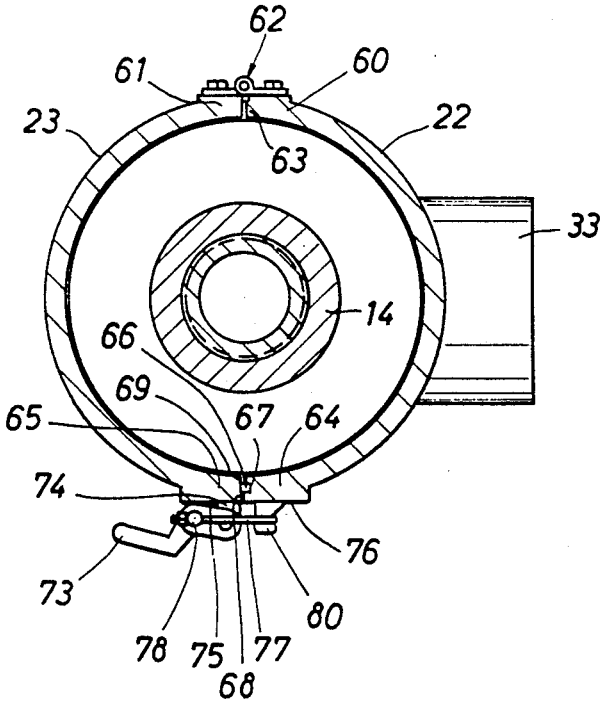
FIG. 3 is an enlarged cross-section taken on line 3—3 of FIG. 2.

Suitable latch means, such as cam latch assemblies 70–72 which are shown in FIGS. 4 and 3, are provided to close the front portions 64, 65 tightly against one another. Each cam latch assembly includes a toggle lever 73 which is pivoted to a base 74 that is secured by studs or the like to one of the flat surfaces 75, 76 of the portions 64, 65. A link 77 which is secured to a cross-rod 78 in the lever 73 can be hooked onto a keeper 80 which is bolted to the other of the flat surfaces 75, 76. When the lever 73 is pivoted outward, the link 77 can be released from the keeper 80 to allow the members 22, 23 to be pivoted outward about the axis of the hinge 62. To close the members 22, 23, they are pivoted or swung toward one another with the lever 73 in its outer position, until the portions 64, 65 engage. The outer end of the link 77 is hooked over the keeper 80, and the lever 73 pivoted inward. The confronting faces of the portions 64, 65 are forced relatively toward one another as the lever 73 is pivoted to its inner position. The cross rod 78 is past center when closed, so that the latch assembly remains closed until the lever 73 is forced outward.

Means such as a pair of grab iron-type handles 82, 83 are secured in vertical positions on the respective outer sides of the respective barrel members 22, 23 as shown in FIG. 2. These handles enable an operator such as a roughneck to manually open and close the members 22, 23 about the drill pipe 10 and the threaded connection 15. Although not shown, one or more hook eyes can be attached to the upper end surface of each barrel member 22, 23, or to upper end surfaces of each semicircular part of the guide sleeve assembly 35, and connected to a chain or rope yoke and a line to suspend the container assembly 20 to the side of and near the rotary table 11. Thus the operator need only apply low lateral force to swing the assembly into and out of position.

OPERATION

The mud collecting assembly of the present invention is assembled as shown in the drawings, and when a threaded connection between triples (or for that matter, a double or a single joint stand of drill pipe) is to be disconnected, the joint 17 is hung off in slips in the rotary table 11. Then the pin 13 is spun by pipe tongs relative to the box 14 until the threads are disengaged, but the pin is still resting on the box to temporarily contain the mud column in the pipe 16 above the connection 15. The assembly 20 in its open condition is positioned around the pipe string with the lower seal ring 25 not far below the box 14, and then closed. The center latch assembly 71 preferably is closed first to bring the confronting surfaces of the members 22, 23 firmly toward one another to compress the seal strips 63, 68, 69, as well as the adjacent outer ends of the packing elements 30, 31, 54 and 54'. Closure of the other latch assemblies 70 and 72 applies additional sealing pressure, so that the mud container barrel 21 is tightly sealed about the pipe 10 and is leak-proof.

Figure 5:
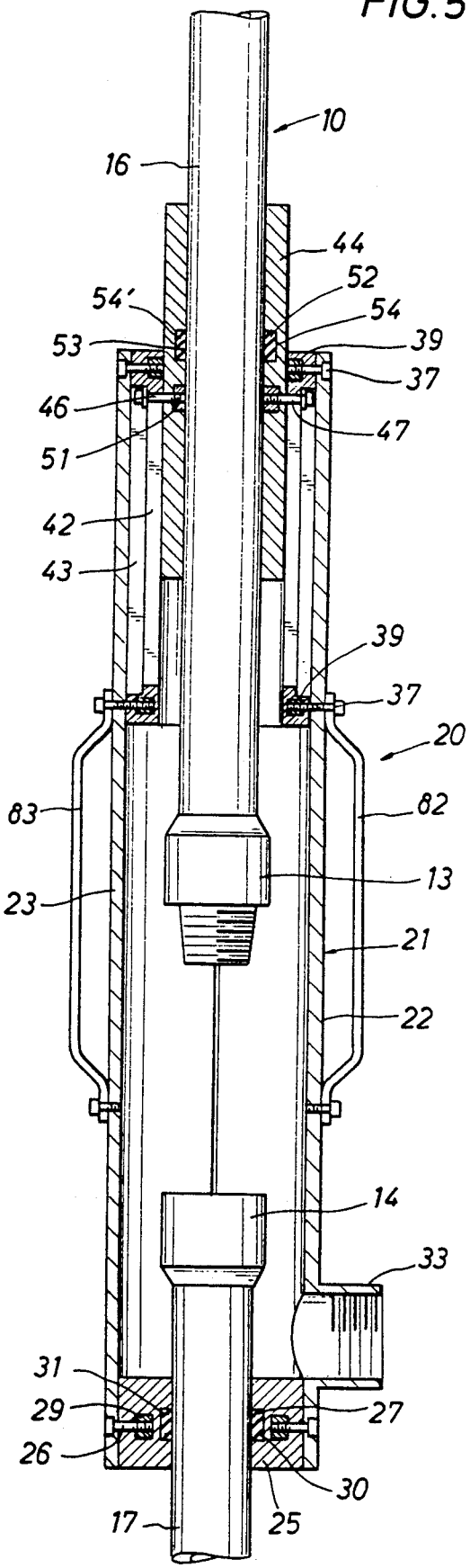
FIG. 5 is a view similar to FIG. 2 but showing the drill pipe raised.

When the container assembly 20 is closed around the pipe 10 as described above, the seal sleeve 44 initially is in its lower position, as shown in FIG. 2, where the bolts 47 provide stops against the bottom ends of the slots 40. Then as the pipe 16 is raised to allow the drilling mud to dump out into the barrel 21, the tight engagement of the packing rings 54, 54' with the adjacent outer surfaces of the pipe causes the seal sleeve 44 to be lifted upward with it. The stand 16 preferably is raised until the bolts 47 come up against the top end surfaces of the slots 40 as shown in FIG. 5, although such raising could be halted at a lesser distance. In any event the column of drilling mud contained in the stand 16 above the connection 15 will dump out into the interior of the barrel assembly 21, and then pass via outlet port 33 and a hose H connected thereto to a mud pit P as shown in FIG. 1. When the mud has emptied out, the barrel members 22, 23 are opened by releasing the latches 70–72 and then swinging the members 22, 23 in opposite outward directions about the hinge assembly 62. The entire container assembly 20 then is shifted aside so that the elevators can be connected to the box 14, and another stand pulled from the well. Of course the process is repeated until the entire string of drill pipe has been tripped out of the hole.

It now will be recognized that a new and improved drilling mud container assembly has been disclosed. Essentially all the mud in each stand of pipe is saved rather than being spilled onto the rig floor. The assembly is leak-proof, and will remain so in repeated use because the upper seal does not move relative to the pipe as the mud is dumped into the barrel of the container. Since certain changes or modifications may be made in the disclosed embodiment without departing from the inventive concepts involved, it is the aim of the appended claims to cover all such changes and modifications falling within the true spirit and scope of the present invention.

What is claimed is:

1. Container means for use in preventing the spilling of drilling mud onto the rig floor upon disconnection of a threaded joint between sections of drill pipe, comprising: an elongated, generally tubular housing assembly having an upper portion and a lower portion; lower seal means on said lower portion arranged to engage outer surfaces of the drill pipe below the threaded joint, said housing assembly including guide means on said upper portion; and upper seal means movable longitudinally relative to said guide means and adapted to provide a static seal against outer surfaces of the drill pipe above the threaded joint, said housing assembly, lower seal means, guide means and upper seal means being formed in semicircular halves which are hinged together to enable said halves to be opened and positioned around the drill pipe and then closed and latched to contain drilling mud that is dumped when the connection is disengaged.

2. The container means of claim 1 further including means for limiting longitudinal relative movement of said upper seal means relative to said guide means at lower and upper positions of said upper seal means.

3. The container means of claim 2 wherein said limiting means includes at least one longitudinally extending slot in said guide means, and stop means on said upper seal means extending laterally into said slot.

4. The container means of claim 1 further including hinge means for pivotally joining said semicircular halves of said housing assembly at the rear thereof to enable said halves to be opened outwardly and closed inwardly relative to one another; and latch means on front portions of said housing assembly halves for securing same together, in a circumferentially continuous manner.

5. The container means of claim 4 further including longitudinally arranged seal means between confronting faces of said halves adjacent said hinge means for preventing leakage of the drilling mud therepast when said halves are closed inwardly.

6. The container means of claim 4 further including longitudinally arranged seal means between confronting faces of said halves adjacent said latch means for preventing leakage of the drilling mud therepast when said halves are closed inwardly.

7. The container means of claim 4 further including handle means on opposite sides of said housing assembly for aiding in the opening and closing thereof.

8. The container means of claim 1 further including mud outlet means adjacent said lower seal means for emptying said housing assembly of drilling mud.

9. A drilling mud containment assembly for use in preventing the spilling of drilling mud onto the rig floor of a drilling rig when a threaded joint in a drill pipe string is disconnected, comprising: a tubular barrel assembly formed by two semicircular halves which are hinged together at the rear portions thereof and releasably latched at the front portions thereof, whereby said halves can be pivoted to an open position to enable said barrel assembly to be positioned around, and removed from around, a length of the drill pipe which extends upward and downward from the threaded connection;

lower seal means on said barrel assembly including an annular member formed in two semicircular halves which are oriented the same as said halves of said barrel assembly, and packing means on the interior of each of said annular members adapted to seal against adjacent walls of the drill pipe below the threaded joint of a drilling rig to prevent leakage therepast when said barrel halves and members are closed; tubular guide means mounted to an upper portion of said barrel assembly, said guide means having at least one longitudinally extending slot formed through a wall thereof, said guide means being formed in two semicircular halves which are oriented the same as the halves of said barrel assembly; upper seal means movable longitudinally relative to said guide means and including a tubular member formed in two semicircular halves which are oriented the same as the halves of said barrel assembly and said guide means, and packing means on the interior of each half of said tubular member adapted to provide a static seal against adjacent walls or the drill pipe above the threaded joint to thereby prevent leakage therepast when said barrel halves, guide member halves and tubular member halves are closed; additional longitudinal seal means on opposing faces adjacent to where said barrel halves are hinged to one another and where said barrel halves are releasably latched to one another for preventing leakage of drill mud past said faces; and drain means through the wall of one of said barrel halves adjacent said lower seal means.

* * * * *